United States Patent [19]

Ross

[11] 4,427,608

[45] Jan. 24, 1984

[54] AUTOMATIC COLD STARTER DEVICES FOR SPARK IGNITION INTERNAL COMBUSTION ENGINES

[75] Inventor: Gray E. D. Ross, Newton Abbot, England

[73] Assignee: Solex (U.K.) Limited, Middlesex, England

[21] Appl. No.: 405,046

[22] Filed: Aug. 4, 1982

Related U.S. Application Data

[63] Continuation of Ser. No. 236,548, Feb. 20, 1981, abandoned.

[30] Foreign Application Priority Data

Feb. 22, 1980 [GB] United Kingdom ..... 8006091

[51] Int. Cl.[3] ..... F02M 1/06

[52] U.S. Cl. ..... 261/39 D; 261/44 C

[58] Field of Search ..... 261/39 D, 44 C

[56] References Cited

U.S. PATENT DOCUMENTS

| | | | |
|---|---|---|---|
| 1,861,725 | 6/1932 | Stokes | 261/39 D |
| 1,904,936 | 4/1933 | Stokes | 261/39 D |
| 1,998,581 | 4/1935 | Holley . | |
| 3,695,591 | 10/1972 | Caisley | 261/39 D |
| 3,885,545 | 5/1975 | Charron et al. | 261/39 D |
| 4,172,864 | 10/1979 | Hohsho et al. . | |
| 4,264,536 | 4/1981 | Yoshioka et al. | 261/39 D |

FOREIGN PATENT DOCUMENTS

| | | | |
|---|---|---|---|
| 2202688 | 2/1975 | Fed. Rep. of Germany | 261/39 D |
| 2180160 | 10/1973 | France . | |
| 1242643 | 8/1971 | United Kingdom . | |
| 1532732 | 11/1978 | United Kingdom . | |

*Primary Examiner*—Tim R. Miles

*Attorney, Agent, or Firm*—Parkhurst & Oliff

[57] ABSTRACT

An automatic cold start fuel supply device for use with constant depression carburetters having a damped air valve, comprises a fuel metering needle movable with engine temperature by a bimetallic element which acts on it indirectly via a rotary member. A spring, which is normally compressed by the action of manifold depression on a diaphragm, is adapted to act when expanded, through the diaphragm and a lever on an arm of the rotary member. The geometry of the lever and the rotary member is such that the rotary member is so positioned by the bimetallic element when the engine is warm that it is not rotated by the load that is applied to its arm by the action of the spring whereas it is so rotated against the action of the bimetallic element when the engine temperature is below the normal running temperature.

12 Claims, 4 Drawing Figures

AUTOMATIC COLD STARTER DEVICES FOR SPARK IGNITION INTERNAL COMBUSTION ENGINES

This is a continuation of application Ser. No. 236,548 filed Feb. 20, 1981, now abandoned.

This invention relates to automatic cold start fuel supply devices for spark ignition internal combustion engines fitted with a carburetter of the constant depression type having a damped air valve piston and a driver operable throttle valve.

U.S. Pat. No. 3,695,591 describes and claims an automatic cold start fuel supply device for an internal combustion engine fitted with a carburetter having a driver operable throttle valve, the device including a fuel supply orifice through which fuel is adapted to be drawn by the suction of the engine, means for varying the effective area of the fuel supply orifice, and a temperture sensitive device operative to position the area varying means, at any given temperature, so as to provide an effective area of the orifice determined by the temperature, the temperature sensitive device also being operative to decrease the effective area of the orifice with increase of temperature and to close that orifice at a predetermined maximum temperature, wherein there are provided spring means to urge the area varying means towards a position in which the effective area of the orifice is a maximum, and means actuable by the engine, when that engine commences to run, to remove the load of the spring means from the area varying means so that the area varying means take up a position determined by the temperature sensitive device and are free to move to reduce the effective area of the orifice under the control of the temperature sensitive device as the temperature increases.

The preferred form of means actuable when the engine commences to run comprise a piston or diaphragm displaceable by the action of the engine suction, the piston or diaphragm being urged by the spring means in the opposite direction to that in which it is moved by engine suction and having a one way connection with the area varying means such that the spring means act on said area varying means to urge said area varying means towards said position in the absence of suction acting on the piston or diaphragm. A bimetallic element is preferred for use as the temperature sensitive device on grounds of expense but it is a resilient component which will yield to the loads to which it is subjected in certain engine operating conditions.

The load of the spring means is reapplied to the area varying means, via the one way connection, when the carburetter throttle valve is opened fully. This is because the manifold depression decreases when the carburetter throttle valve is opened fully. That spring load can overcome the action of the bimetallic element on the area varying means and cause movement of the area varying means in the direction in which it enlarges the effective area of the orifice. Whilst this characteristic is desirable during the engine warm up phase that extends from the instant the engine commenced to run under its own power and continues until the engine temperature reaches said predetermined maximum temperature, it can be undesirable during normal running of the engine when the fuel supply orifice has been closed and the temperature of the engine is at or above said predetermined maximum temperature. However, the ability of the device to automatically supply the extra fuel required by the engine for acceleration whilst the engine is being warmed up is impaired if the temperature sensitive means and the spring means are selected so that the spring load does not overcome the action of the temperature sensitive means when it is reapplied to the area varying means following opening of the engine carburetter throttle valve.

An object of this invention is to ensure that the fuel supply orifice of an automatic cold start fuel supply device of the kind that is described and claimed in U.S. Pat. No. 3,695,591 remains closed when the temperature of the engine to which the device is fitted is at or above the predetermined maximum temperature for normal running of the engine even though the throttle valve of the carburetter fitted to the engine is opened fully to accelerate the engine, whilst retaining the characteristic whereby the area varying means of the device are moved automatically to increase the effective area of the orifice when the throttle valve of the engine carburetter is opened fully to accelerate the engine once the engine has commenced running under its own power and until it has warmed up to said predetermined maximum temperature.

According to this invention there is provided an automatic cold start fuel supply device for a spark ignition internal combustion engine fitted with a carburetter of the constant depression type having a damped air valve piston and a driver operable throttle valve separated by a mixing chamber in which a substantially constant depression is maintained by operation of the carburetter; the device comprising a casing, a fuel supply orifice formed within the casing and through which fuel is adapted to be drawn by the mixing chamber depression, and including means for varying the effective area of the fuel supply orifice, a rotary member coupled to the area varying means so that rotation of the rotary member causes movement of the area varying means to vary the effective area of the orifice, a temperature sensitive device operative to position the area varying means, at any given temperature, so as to provide an effective area of the orifice determined by that temperature and also operative to decrease the effective area of the fuel supply orifice with increase of temperature and to close that orifice at a predetermined maximum temperature, the temperature sensitive device acting on the rotary member so that the action of the temperature sensitive device with increase of temperature tends to rotate the rotary member in the direction to reduce the effective area of the orifice there being spring means provided to urge said area varying means towards a position in which the effective area of the fuel supply orifice is a maximum, the load exerted by the spring means being transmitted to the area varying means by rotation of the rotary member, and means actuable by the engine, when that engine commences to run under its own power, to remove the load of the spring means from the rotary member so that said area varying means take up a position determined by the temperature sensitive device and are free to move to reduce the effective area of the fuel supply orifice under the control of the temperature sensitive device as the temperature increases, wherein rigid load reacting means which are mounted in the casing and which react any load exerted on the rotary member by the action of the spring means when the temperature of the engine is at or above said predetermined temperature are provided so that the rotary member is not rotated by the action of the spring means from the position in which it is located by the temperature sensitive device when the temperature of the engine is at or above said predetermined temperature.

Preferably the load reacting means comprise a fixed support for the rotary member, said temperature sensitive device being adapted to position said rotary member relative to said fixed support when the temperature of the engine is at or above said predetermined temperature such that the line of action of any load applied to the rotary member by the action of said spring means passes sufficiently adjacent to said fixed support for the rotary member to be not rotated by it. More specifically, the geometry of the rotary member in relation to the line of action on it of the load exerted by the action of the spring means is preferably such that that line of action passes to one side of the axis of rotary movement of the rotary member when the temperature of the engine is below said predetermined maximum temperature so that the application of any load exerted on that rotary member by the action of the spring means is accompanied by angular movement of that rotary member in the direction to move said area varying means in the direction to increase the effective area of the fuel supply orifice, whereas said line of action passes through or substantially adjacent to the axis of rotary movement of the rotary member when the temperature of the engine is at or above said predetermined maximum temperature and the orifice is closed so that said rotary member is positioned to locate the area varying means in the position to close the orifice and the application of any load exerted on the rotary member by the action of the spring means when the temperature of the engine is at or above said predetermined maximum temperature does not cause angular movement of the rotary member from that locating position.

Preferably the temperature sensitive device is adapted to exert a resilient load on the area varying means which varies with variation in temperature whereby to position the area varying means. The temperature sensitive device may be a coiled bimetallic element.

Preferably a lever is provided for transmitting the load exerted by the spring means to the rotary member. The portion of the surface of the lever that contacts the rotary member throughout the range of movement of the lever and the rotary member during the operation of the device may be profiled so that the line of action of the load exerted on the rotary member by the spring means is varied to control the torque that is applied to the rotary member. Preferably the load exerted by the spring means is applied to the lever through a diaphragm of impervious flexible material which is displaceable against the action of the spring means by the action of engine suction and which comprises said means actuable when the engine commences to run. Conveniently the load exerted by the spring means is applied through the diaphragm to the lever via a roller which is carried by the lever in rolling engagement with the diaphragm for rotary movement relative to the lever. The roller may be snap fitted into a recess in the lever.

An air/fuel induction system for a spark ignition internal combustion engine which incorporates a carburetter of the substantially constant depression type and an automatic auxiliary cold start fuel supply device in which this invention is embodied is described now by way of example with reference to the accompanying drawings, of which:

Figure 1:
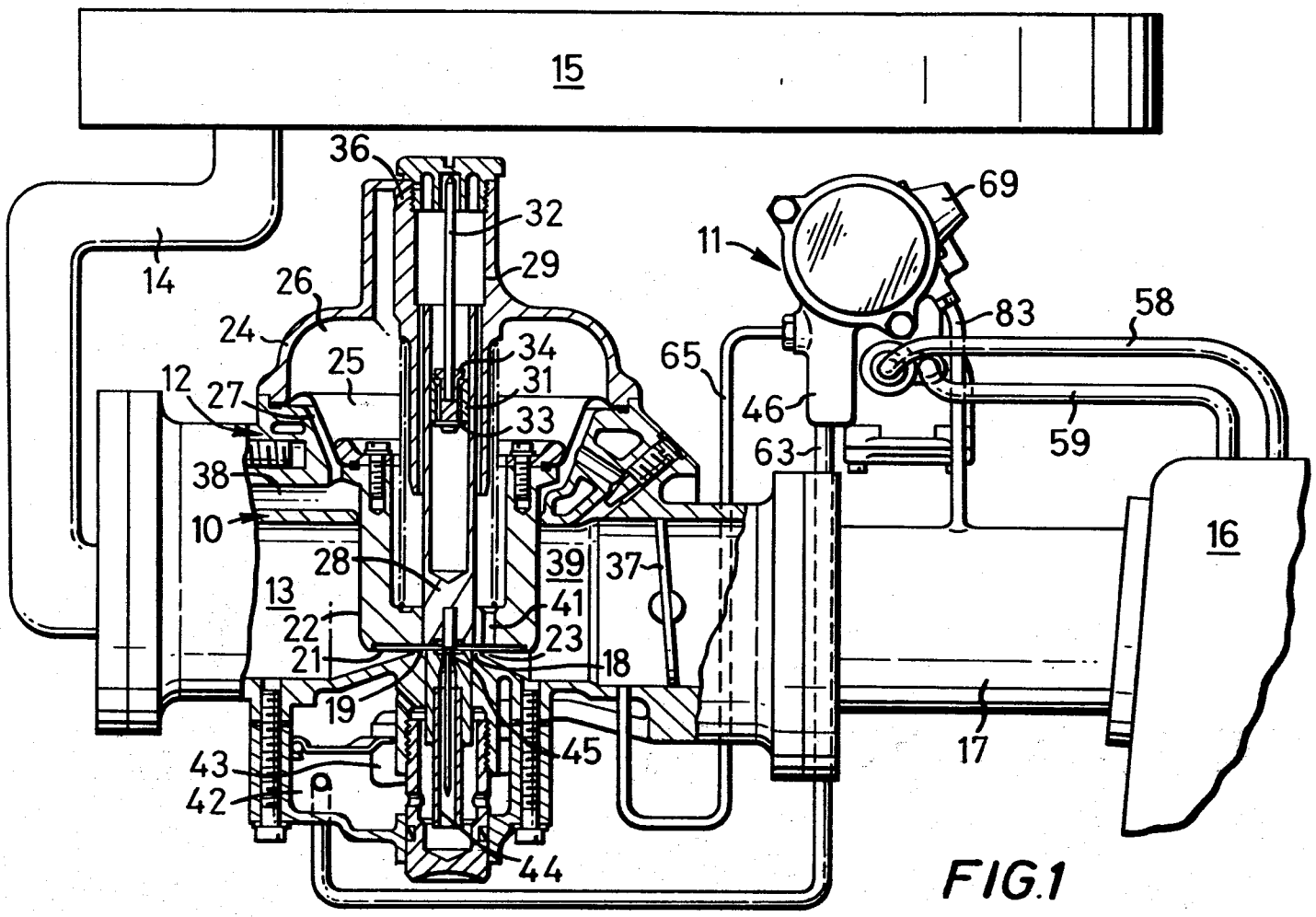
FIG. 1 is a diaphragm of the system with the carburetter shown in section and the remainder being shown in elevation.

The internal combustion engine installation for a motor vehicle shown diagrammatically in FIG. 1 includes a carburetter 10 of the substantially constant depression type and an auxiliary cold start fuel supply device 11.

The carburetter 10 comprises the usual body 12 having an induction passage 13 extending through it. One end, the upstream end, of the induction passage 13 is connected by a pipe 14 to an outlet of an air filter 15 and the other or downstream end of the induction passage 13 is connected to the inlet manifold of the engine 16 by a pipe 17. A bridge member 18 formed in the induction passage 13 has a flat surface 19 which is chordal to the axis of the passage 13. The flat surface 19 co-operates with a flat end surface 21 of an air valve slide piston 22 to define a throat 23. The air valve slide piston 22 is movable across the passage 13 in a direction normal to the flat surface 19 so as to vary the area of the throat 23.

The air valve slide piston 22 extends through an opening in the side wall of the induction passage 13 into a space formed by a cavity in the body 12 and a cap member 24, and is mounted in the central aperture of an annular diaphragm 25 of flexible material. The outer periphery of the annular diaphragm 25 is clamped between the body 12 and the cap member 24 so as to divide the space defined between the body 12 and the cap member 24 into two compartments 26 and 27. The air valve slide piston 22 is cup-shaped, the flat end surface 21 being the outer surface of the base of the cup. An open-topped dashpot 28, which is secured to the base of the cavity of the cup-shaped air valve slide piston 22 projects substantially normal from that base and extends upwardly into a downwardly opening cylinder 29 which is formed coaxially in the cap member 24. An annular piston 31, carried at the lower end of a dependent piston rod 32 which is mounted in the cap member 24, is immersed in damping fluid within the dashpot 28. The piston 31 is arranged for limited axial movement relative to the piston rod 32, between a circlip 33 mounted on the lower end of the piston rod 32 and a radial flange 34 carried by the piston rod 32 between the piston 31 and the cap member 24. When the piston 31 rests upon the circlip 33, liquid can flow freely between the inner wall of the piston 31 and the piston rod 32 as well as between the outer surface of the piston 31 and the cylindrical wall of the dashpot 28. When the piston 31 is in engagement with the radial flange 34, flow of fluid between the inner surface of the annular piston 31 and the piston rod 32 is prevented so that relative movement between the piston 31 and the dashpot 28 is governed by the restricted flow of damping fluid between the radially outer surface of the piston 31 and the cylindrical wall of the dashpot 28.

A vent passage 36 in the cap member 24 places the cavity of the downwardly-opening cylinder 29 in communication with the compartment 26.

A driver-controlled butterfly throttle valve member 37 is provided in the induction passage 13 downstream of the air valve slide piston 22. The compartment 27 between the annular diaphragm 25 and the body 12 is in communication with the interior of the engine compartment of the vehicle outside the body 12 via a passage 38 in the body 12 and the compartment 26 between the diaphragm 25 and the cap member 24 is in communication with the mixing chamber 39 between the air valve slide piston 22 and the throttle valve 37, via a passage 41 in the piston 31.

Movement of the air valve slide piston 22 is controlled in the usual manner by differential air pressure acting on the diaphragm 25 so that the position of the air valve slide piston 22 is governed by the depression within the mixing chamber 39 and so that the air valve slide piston 22 moves automatically to modulate air flow through the throat 23 into the mixing chamber 39 so as to counteract any tendency for the depression in the mixing chamber 39 to vary and thereby to maintain that depression substantially constant, that is to say between acceptable upper and lower limits. The magnitude of the depression in the mixing chamber 39 tends to increase with opening of the throttle valve 37. It follows that the depression in the compartment 26 tends to increase as well so that the air valve slide piston 22 moves away from the bridge 18 to increase the area of the throat 23. The piston 31 is forced into abutment with the radial flange 34 by damping fluid between the piston 31 and the closed end of the dashpot 18 when the air valve slide piston 22 moves away from the bridge 18 to increase the area of the throat 23. Thus such movement of the air valve slide piston 22 is damped. Hence the depression in the mixing chamber 39 tends to increase throughout the transient conditions that prevail whilst the throttle valve 37 is being opened to increase the speed of the engine 16 and because the resultant movement of the air valve slide piston 22 is damped, the depression in the compartment 26 tends to increase to a greater degree. Movement of the air valve slide piston 22 towards the bridge 18 is relatively free due to the fact that the annular piston 31 rests upon the circlip 33 and damping fluid can flow through the annular passage defined between the inner wall of the piston 31 and the piston rod 32. Hence the depression in the compartment 26 tends to fall to the same extent as does the depression in the mixing chamber 39 during the transient conditions that prevail whilst the throttle valve 37 is being closed and the air valve slide piston 22 moves towards the bridge 18 to reduce the area of the throat 23 and thus to oppose that tendency.

Fuel is drawn into the induction passage 13 of the carburetter 10 from a fuel chamber 42. The fuel level in the fuel chamber 42 is controlled by the usual float 43. Fuel drawn from the fuel chamber 42 is drawn through a fuel supply jet 44 mounted in a bore in the carburetter body 12 and opening into a flat surface 19 of the bridge 18, the jet 44 having a bore portion 45 of reduced diameter which constitutes the fuel metering orifice.

Figure 2:
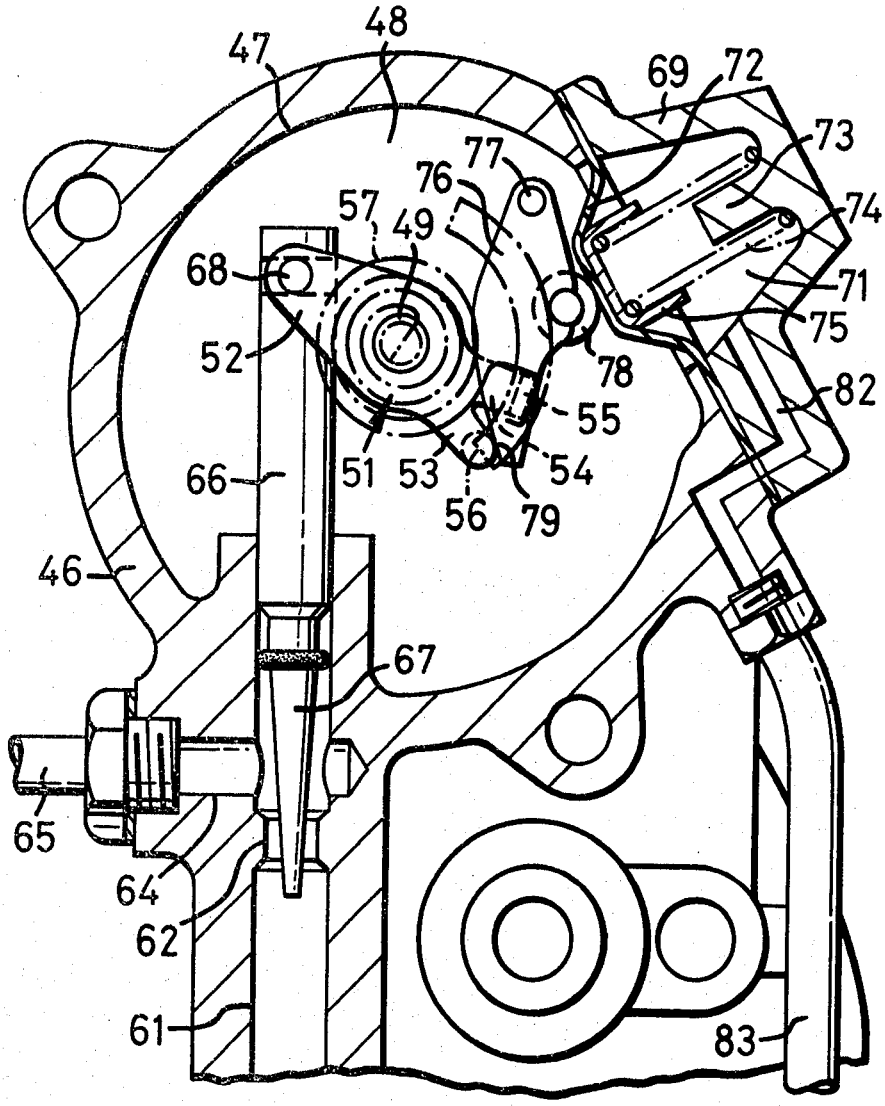
FIG. 2 is a sectioned fragment to a larger scale of the automatic cold start fuel supply device which is incorporated in the induction system illustrated in FIG. 1, the parts of the device being shown in the position they occupy when the engine to which the device is fitted is cold and not running.
Figure 3:
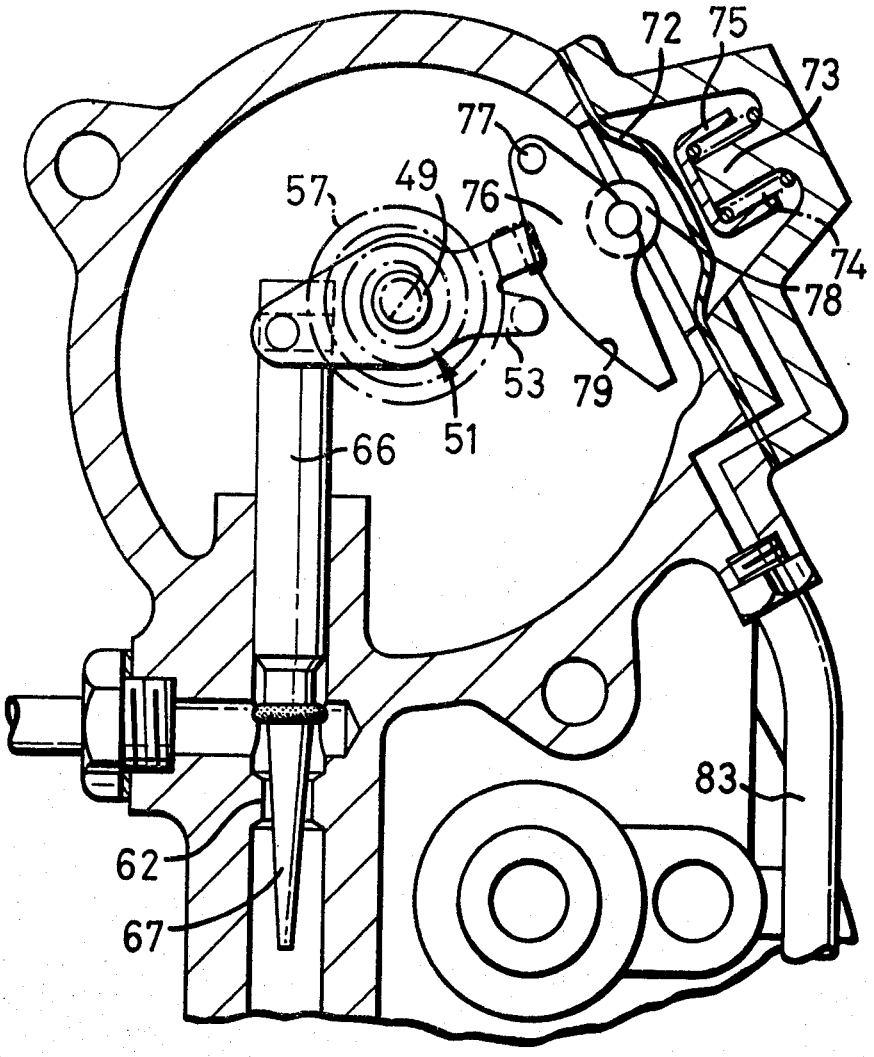
FIG. 3 is similar to FIG. 2 and illustrates the operation of parts of the device when the engine is running under its own power below its normal operating temperature.
Figure 4:
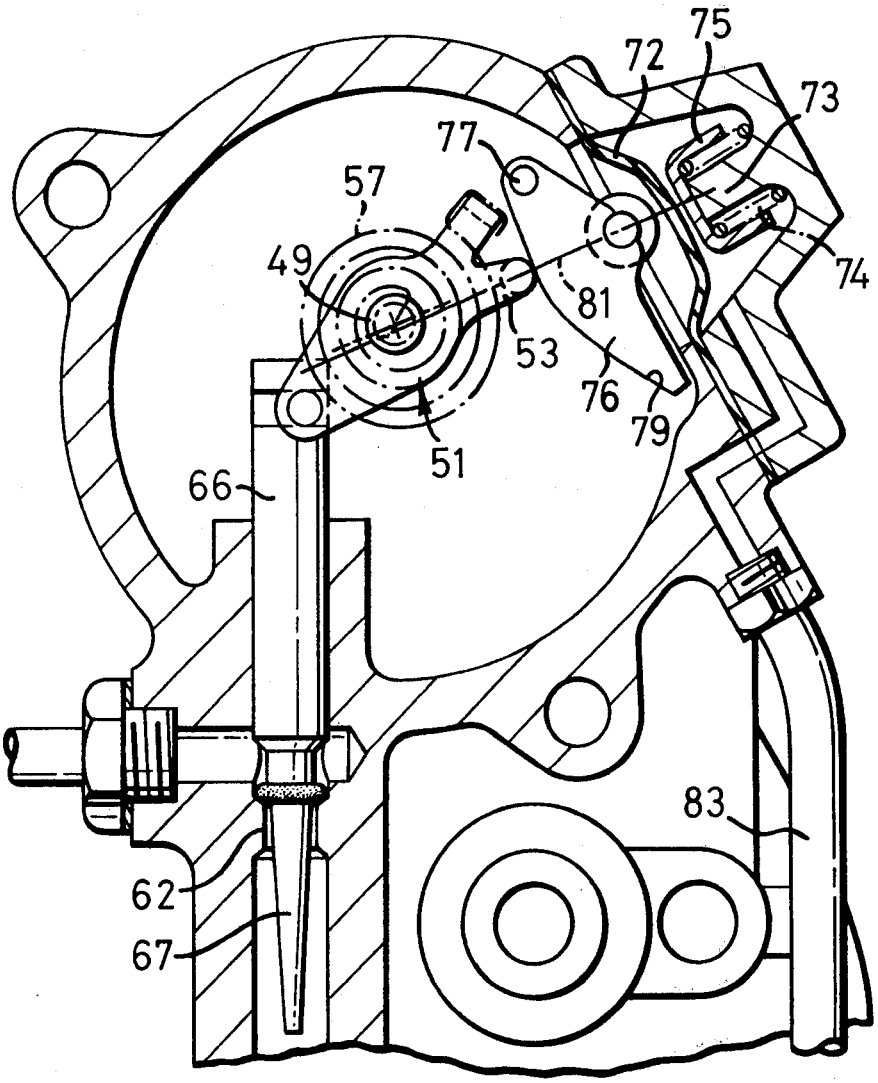
FIG. 4 is similar to FIGS. 2 and 3 and shows the same parts in the relative positions they adopt when the engine has warmed up to the normal running temperature at which the supply of extra fuel by the device is not required.

The auxiliary cold start fuel supply device 11 of which a part is shown in FIG. 2, comprises a casing 46 which, although shown spaced from the carburetter 10 in FIG. 1, is mounted in a known manner on the body 12 of the carburetter 10 in practice. The casing 46 defines a substantially circular chamber 47 which is divided into two substantially circular compartments by a substantially circular transverse separator 48 which is formed of a rigid plastics material. A fixed spindle 49 is mounted at the centre of one of the two circular compartments. A rotary member 51 is mounted for rotation on the spindle 49 and has three angularly spaced radially-extending arms 52, 53 and 54. The outer end of the arm 54 has an axially-extending portion 55 which projects through an arcuate slot 56 in the separator 48 into the other compartment. A coiled bimetallic element 57 is housed in the other compartment. It has its inner end held in a slot in a boss formed by the casing 46 in that other compartment, its outer end anchored to the axially-extending end portion 55 of the arm 54 and is arranged so that when heated it tends to tighten its turns and so move the rotary member 51 anti-clockwise as seen in FIGS. 2 to 4 of the drawings. The other compartment is surrounded by a water jacket (not shown) which is formed by the casing 46. The water jacket is connected into the cooling water system of the engine 16 by pipes 58 and 59 (see FIG. 1).

A bore 61 in the casing 46 opens into the compartment of the chamber 47 in which the rotary member 51 is mounted, and has a restricted portion defining a metering orifice 62. The axis of the bore 61 is tangential to a circle about the axis of the spindle 49. The end of the bore 61 remote from the chamber 47 is connected to the float chamber 42 of the carburetter 10 by a pipe 63 (FIG. 1) and a branch passage 64 connects the portion of the bore 61 between the metering orifice 62 and the chamber 47 with the mixing chamber 39 of the carburetter 10 via a pipe 65. A plunger 66 is slidable in that part of the bore 61 that extends between the branch passage 64 and the chamber 47 and carries a profiled needle 67 which extends into the metering orifice 62. The plunger 66 is pivotally coupled at 68 to the arm 52 of the rotary member 51.

The part 69 of the casing 46 on the opposite side of the spindle 49 from the plunger 66 is separable and forms an outwardly tapering cavity 71. A diaphragm 72 of flexible impervious material has its periphery clamped between the separable casing part 69 and the remainder of the casing 46 so that it closes the cavity 71 at its larger end.

A post 73, which is formed integrally with the separable casing part 69, projects from the base of the cavity 71 towards the diaphragm 72. A coiled compression spring 74 has one end turn surrounding the post 73 and abutting the base of the cavity 71. The other end turn of the coil spring 74 is received within the cavity of a cup-shaped member 75, which is urged against the mid portion of the diaphragm 72 by the spring 74.

A lever 76 is fulcrummed at one end about a pivot pin 77 which is fixed to the casing 46. The lever 76 extends between the diaphragm 72 and the arm 53 of the rotary member 51. A roller 78 is journaled in a corresponding recess in the edge of the lever 76 adjacent the diaphragm 72 and is snap fitted into that recess. The edge 79 of the lever 76 adjacent the rotary member 51 is profiled. The profile of the lever edge 79 is such that, when the spring 74 urges the diaphragm 72 against the roller 78 and thereby urges the profiled lever edge 79 against the arm 53 of the rotary member 51, the instantaneous line of action of the force applied to the arm 53 through the lever 76 is varied to provide a controlled predetermined variation in the torque on the lever 76. The geometrical arrangement of the rotary member 51 and its arms 52 and 53, and of the lever 76 and its fixed pivot 77 and profiled edge 79 are such that the line of action of the load exerted by the spring 74 as applied to the rotary member 51 via the lever 76 is displaced to one side of the pivot axis of the rotary member 51 by a significant distance as shown in FIG. 2, when the engine to which the device is fitted is cold and not running, and thus tends to rotate the rotary member 51 clockwise as seen in FIGS. 2, 3 and 4, thereby withdrawing the needle 67 from the orifice 62 to an extent limited by the opposing force of the coiled bimetallic element 57 and depending on the temperature to which that element 57 is subjected, whereas when the needle 67 is seated to close the orifice 62 to fuel flow therethrough, the line of action of the load exerted by the spring 74 as applied to the rotary member 51 via the lever 76 passes sufficiently close to the axis of the fixed spindle 49, as is illustrated by the line 81 in FIG. 4, for the torque that is applied to the rotary member 51 by that load to be too small to overcome the action of friction between the rotary member 51 and the spindle 49. In the optimum arrangement, the distance between the line of action 81 and the axis of the spindle 49 in the latter condition is such that the torque applied to the rotary member 51 via the lever 76 counter-balances the torque due to friction between the rotary member 51 and the spindle 49.

Also mounted to rotate on the spindle 49 is a member (not shown) having a stepped cam edge and an outwardly projecting arm as is described in U.S. Pat. No. 3,695,591. The stepped cam edge co-operates with a plunger to provide a fast idle stop for the carburreter throttle valve 37. A pin may be provided to act on the outwardly projecting arm to rotate the member in order to move the stepped cam edge out of engagement with the plunger to permit initial setting of the interconnected throttle control mechanism.

The cavity 71 is connected through a passage 82 in the casing 46, a pipe 83 and the pipe 17 (see FIG. 1) to the engine inlet manifold so that suction is created in the cavity 71 when the engine 16 is running.

When the engine 16 is stationary and cold, the diaphragm 72, not being subject to suction, will be urged by the spring 74 to the position shown in FIG. 2, the force of the spring 74 rotating the rotary member 51 clockwise in opposition to any load exerted on it by the coiled bimetallic element 57 which is dependent on the temperature of the engine 16, and thus moving the needle 67 to a position of least obstruction of the orifice 62.

Thus, during cranking of the engine 16, increased enrichment of the fuel/air mixture is provided in a manner which may be controlled. As soon as the engine 16 fires and begins to run under its own power, suction acts on the diaphragm 72 to draw it away from the fixed spindle 49 and separate it from the roller 78 (as shown in FIG. 3), thereby compressing the coil spring 74 and relieving the rotary member 51 of its load. Hence the rotary member 51 takes up a position somewhere between its extreme positions, the position taken up being dependent on the temperature of the engine 16 and being determined solely by the bimetallic element 57, and the needle 67 reduces the effective area of the orofice 62 as soon as the temperature rises above the value at which the bimetallic element 57 alone will drive the mechanism to the full rich position.

Any increase in temperature from that existing when the engine 16 was started is thus immediately effective to move the needle 67 to further obstruct the orifice 62, due to the action of the bimetallic element alone, and, from the moment of starting, the fuel supply is progressively restricted with increase of temperature, until the orifice 62 is finally closed. Movement of the needle 67 from position in which it closes the orifice 62 by the action of the compression spring 74 acting through the lever 76 and the rotary member 51 is prevented by the rotary member 51, as long as the engine temperature does not fall below the temperature at which the needle 67 seated to close the orifice 62. The rotary member 51 prevents unseating of the needle 67 because it is orientated as shown in FIG. 4 in a position in which any tendency for the coil spring 74 to expand and load the lever 76 onto the arm 53 cannot cause rotation of the rotary member 51 because the line of action 81 of the load that is applied to the rotary member 51 by the action of the spring 74 via the lever 76 is sufficiently close to the axis of the spindle 49 for the torque that is applied to the rotary member 51 to not be sufficient to overcome the torque due to friction between the spindle 49 and the rotary member 51. It will be understood that the lever 76 and the rotary member 51 co-operate together as a rigid strut which opposes expansion of the spring 74 which would cause rotation of the rotary member 51 when the mechanism is in the condition shown in FIG. 4, that spring loading therefore being reacted by the fixed spindle 49, whereas they are movable angularly relative to one another in opposite directions when loaded whilst in any other relative location in which the line of action of the load that is applied to the rotary member 51 by the action of the spring 74 via the lever 76 is spaced sufficiently from the axis of the spindle 49 for the torque that is applied to the rotary member 51 by that load to be sufficient to overcome friction between the rotary member 51 and the spindle 49.

Whenever the engine 16 is stopped, the spring 74 will urge the diaphragm 72 towards the position shown in FIG. 2 but, until the engine 16 has cooled to some predetermined temperature, the bimetallic coil 57 will offer sufficient resistance to prevent full movement of the diaphragm 72 by the spring 74 to that position so that it will be moved to an intermediate position. The time interval between stopping of the engine 16 and withdrawal of the needle 67 from the orifice will be minimised if the mechanism is arranged so that the torque applied to the rotary member 51 by the action of the coil spring 74 is just counter-balanced by the torque due to the action of friction between the rotary member 51 and the spindle 49. If the engine 16 is cold when restarted, the rotary member 51 will rotate under the influence of the bimetallic element 57 to set the needle 67 to a position appropriate to the actual temperature of the engine 16 as soon as the engine 16 starts.

I claim:

1. In a spark ignition internal combustion engine fitted with a carburetor having a driver operable throttle valve, an automatic cold start fuel supply device comprising a casing, a fuel supply orifice formed within the casing and through which fuel is adapted to be drawn by the mixing chamber depression, means for varying the effective area of the fuel supply orifice, a rotary member coupled to the area varying means so that rotation of the rotary member causes movement of the area varying means to vary the effective area of the orifice, a temperature sensitive device operative to position the area varying means, at any given temperature, so as to provide an effective area of the orifice determined by that temperature and also operative to continuously decrease the effective area of the fuel supply orifice with every increase of temperature and to close that orifice at a predetermined maximum temperature, the temperature sensitive device acting on the rotary member so that the action of the temperature sensitive device with increase of temperature tends to rotate the rotary member in the direction to reduce the effective area of the orifice, spring means provided to urge said area varying means towards a position in which the effective area of the fuel supply orifice is a maximum, the load exerted by the spring means being transmitted to the area varying means by rotation of the rotary member, and means actuable by the engine, when that engine commences to run under its own power, to remove the load of the spring means from the rotary member so that said area varying means take up a position determined by the temperature sensitive device and are free to move to reduce the effective area of the fuel supply orifice under the control of the temperature sensitive device as the temperature increases up to said predetermined maximum temperature, means to replace said load of the spring to increase the effective area of said fuel supply orifice when the engine is accelerated while operating at a temperature below said predetermined maximum temperature, rigid load reacting means, which do not require the use of separate thermostatic means, mounted in the casing and which react any load exerted on the rotary member by the action of the spring means only when the temperature of the engine is at or above said predetermined temperature so that the rotary member is not rotated by the action of the spring means from the position in which it is located by the temperature sensitive device when the temperature of the engine is at or above said predetermined temperature, said rigid load reacting means allowing the effect of the spring means to vary the effective area of the fuel supply orifice when the engine is operating at a temperature below said predetermined maximum temperature.

2. An automatic cold start fuel supply device for a spark ignition internal combustion engine fitted with a carburetor of the constant depression type having a damped air valve piston and a driver operable throttle valve separated by a mixing chamber in which a substantially constant depression is maintained by operation of the carburetor; the device comprising a casing, a fuel supply orifice formed within the casing and through which fuel is adapted to be drawn by the mixing chamber depression and including means for varying the effective area of the fuel supply orifice, a rotary member coupled to the area varying means so that rotation of the rotary member causes movement of the area varying means to vary the effective area of the orifice, a temperature sensitive device operative to position the area varying means at any given temperature, so as to provide an effective area of the orifice determined by that temperature and also operative to decrease the effective area of the fuel supply orifice with increase of temperature and to close that orifice at a predetermined maximum temperature, the temperature sensitive device acting on the rotary member so that the action of the temperature sensitive device with increase of temperature tends to rotate the rotary member in the direction to reduce the effective area of the orifice, spring means urging said area varying means towards a position in which the effective area of the fuel supply orifice is a maximum, the load exerted by the spring means being transmitted to the area varying means by rotation of the rotary member, means actuable by the engine, when that engine commences to run under its own power, to remove the load of the spring means from the rotary member so that said area varying means take up a position determined by the temperature sensitive device and are free to move to reduce the effective area of the fuel supply orifice under the control of the temperature sensitive device as the temperature increases, and rigid load reacting means which are mounted in the casing and which react any load exerted on the rotary member by the action of the spring means when the temperature of the engine is at or above said predetermined temperature so that the rotary member is not rotated by the action of the spring means from the position in which it is located by the temperature sensitive device when the temperature of the engine is at or above said predetermined temperature, said load reacting means comprising a fixed support for the rotary member and said temperature sensitive device being adapted to position said rotary member relative to said fixed support when the temperature of the engine is at or above said predetermined temperature such that the line of action of any load applied to the rotary member by the action of said spring means passes sufficiently adjacent to said fixed support for the rotary member not to be rotated by it.

3. In a spark ignition internal combustion engine fitted with a carburetor of the constant depression type having a damped air valve piston and a driver operable throttle valve separated by a mixing chamber in which a substantially constant depression is maintained by operation of the carburetor, an automatic cold start fuel supply device comprising a casing, a fuel supply orifice formed within the casing and through which fuel is adapted to be drawn by the mixing chamber depression, means for varying the effective area of the fuel supply orifice, a rotary member coupled to the area varying means so that rotation of the rotary member causes movement of the area varying means to vary the effective area of the orifice, a temperature sensitive device operative to position the area varying means, at any given temperature, so as to provide an effective area of the orifice determined by that temperature and also operative to continuously decrease the effective area of the fuel supply orifice with every increase of temperature and to close that orifice at a predetermined maximum temperature, the temperature sensitive device acting on the rotary member so that the action of the temperature sensitive device with increase of temperature tends to rotate the rotary member in the direction to reduce the effective area of the orifice, spring means provided to urge said area varying means towards a position in which the effective area of the fuel supply orifice is a maximum, the load exerted by the spring means being transmitted to the area varying means by rotation of the rotary member, and means actuable by the engine, when that engine commences to run under its own power, to remove the load of the spring means from the rotary member so that said area varying means take up a position determined by the temperature sensitive device and are free to move to reduce the effective area of the fuel supply orifice under the control of the temperature sensitive device as the temperature increases up to said predetermined maximum temperature, means to replace said load of the spring to increase the effective area of said fuel supply orifice when the engine is accelerated while operating at a temperature below said predetermined maximum temperature, rigid load reacting means, which do not require the use of separate thermostatic means, mounted in the casing and which react any load exerted on the rotary member by the action of the spring means only when the temperature of the engine is at or above said predetermined temperature so that the rotary member is not rotated by the action of the spring means from the position in which it is located by the temperature sensitive device when the temperature of the engine is at or above said predetermined temperature, said rigid load reacting means allowing the effect of the spring means to vary the effective area of the fuel supply orifice when the engine is operating at a temperature below said predetermined maximum temperature.

4. The automatic cold start device of claim 3 wherein rotation of said rotary member by the action of the spring means is opposed only by the action of friction and said temperature sensitive device, when the temperature of the engine is below said predetermined temperature.

5. An automatic cold start device for a spark ignition internal combustion engine fitted with a caburetor of the constant depression type having a damped air valve piston and a driver operable throttle valve separated by a mixing chamber in which a substantially constant depression is maintained by operation of the caburetor; the device comprising a casing, a fuel supply orifice formed within the casing and through which fuel is adapted to be drawn by the mixing chamber depression and including means for varying the effective area of the fuel supply orifice, a rotary member coupled to the area varying means so that rotation of the rotary member causes movement of the area varying means to vary the effective area of the orifice, a temperature sensitive device operative to position the area varying means, at any given temperature, so as to provide an effective area of the orifice determined by that temperature and also operative to decrease the effective area of the fuel supply orifice with increase of temperature and to close that orifice at a predetermined maximum temperature, the temperature sensitive device acting on the rotary member so that the action of the temperature sensitive device with increase of temperature tends to rotate the rotary member in the direction to reduce the effective area of the orifice, there being spring means provided to urge said area varying means towards a position in which the effective area of the fuel supply orifice is a maximum, the load exerted by the spring means being transmitted to the area varying means by rotation of the rotary member, means actuable by the engine, when that engine commences to run under its own power, to remove the load of the spring means from the rotary member so that said area varying means take up a position determined by the temperature sensitive device and are free to move to reduce the effective area of the fuel supply orifice under the control of the temperature sensitive device as the temperature increases, and rigid load reacting means which are mounted in the casing and which react any load exerted on the rotary member by the action of the spring means when the temperature of the engine is at or above said predetermined temperature so that the rotary member is not rotated by the action of the spring means from the position in which it is located by the temperature sensitive device when the temperature of the engine is at or above said predetermined temperature, the geometry of the rotary member in relation to the line of action on it of the load exerted by action of the spring means being such that that line of action passes to one side of the axis of rotary movement of the rotary member when the temperature of the engine is below said predetermined maximum temperature so that application of any load exerted on that rotary member by the action of the spring means is accompanied by angular movement of that rotary member in the direction to move said area varying means in the direction to increase the effective area of the fuel supply orifice, whereas said line of action passes sufficiently adjacent to the axis of rotary movement of the rotary member when the temperature of the engine is at or above said predetermined maximum temperature and the orifice is closed so that said rotary member is positioned to locate the area varying means in the position to close the orifice and application of any load exerted on the rotary member by the action of the spring means when the temperature of the engine is at or above said predetermined maximum temperature does not cause angular movement of the rotary member from that locating position.

6. An automatic cold start fuel supply device according to claim 5, wherein the temperature sensitive device is adapted to exert a resilient load on the area varying means which varies with variation in temperature whereby to position the area varying means.

7. An automatic cold start fuel supply device according to claim 6, wherein the temperature sensitive device is a coiled bimetallic element.

8. An automatic cold start fuel supply device according to claim 5 wherein a lever is provided for transmitting the load exerted by the spring means to the rotary member.

9. An automatic cold start fuel supply device according to claim 8, wherein the portion of the surface of the lever that contacts the rotary member throughout the range of movement of the lever and the rotary member during the operation of the device is profiled so that the line of action of the load exerted on the rotary member by the action of the spring means is varied to control the torque that is applied to the rotary member.

10. An automatic cold start fuel supply device according to claim 8, wherein the load exerted by the spring means is applied to the lever through a diaphragm of impervious flexible material which is displaceable against the action of the spring means by the action of engine suction and which comprises said means actuable when the engine commences to run.

11. An automatic start fuel supply device according to claim 10, wherein the load exerted by the spring means is applied through the diaphragm to the lever via a roller which is carried by the lever in rolling engagement with the diaphragm for rotary movement relative to the lever.

12. An automatic cold start fuel supply device according to claim 11, wherein the roller is snap fitted into a recess in the lever.

* * * * *